US005997311A

United States Patent [19]

Crouse et al.

[11] Patent Number: 5,997,311

[45] Date of Patent: Dec. 7, 1999

[54] INTERCONNECT AND CROSS-CONNECT EQUIPMENT PANEL FOR TELECOMMUNICATIONS APPARATUS

[75] Inventors: Douglas N. Crouse, Succasunna; Errol G. Francis, Burlington; Christopher N. Helmstetter, Bridgewater; Norris B. McLean, Englewood; Mark G. Spaulding, Florham Park, all of N.J.

[73] Assignee: Lucent Technologies Inc., Murray Hill, N.J.

[21] Appl. No.: 09/066,003

[22] Filed: Apr. 24, 1998

[51] Int. Cl.[6] ..... H01R 29/00

[52] U.S. Cl. ..... 439/49; 439/188

[58] Field of Search ..... 439/49, 188, 571; 361/733, 827; 379/328, 668

[56] References Cited

U.S. PATENT DOCUMENTS 5,497,444 3/1996 Wheeler ..... 385/135

5,552,962 9/1996 Feustel et al. ..... 361/733

FOREIGN PATENT DOCUMENTS

WO/10325 9/1990 WIPO ..... 439/49

*Primary Examiner*—Lincoln Donovan

*Assistant Examiner*—J. F. Duverne

[57] ABSTRACT

An improved interconnect and cross-connect equipment panel for telecommunications apparatus holds jack panel modules (20) with connections to their rear and connector modules (20) with interconnected front and rear connectors. Patch cords (52) are utilized at the rear of the panel to interconnect a jack panel module with a connector module so that telecommunications apparatus connected to the rear of a jack panel module is accessible from the front of a connector module.

7 Claims, 5 Drawing Sheets

INTERCONNECT AND CROSS-CONNECT EQUIPMENT PANEL FOR TELECOMMUNICATIONS APPARATUS

BACKGROUND OF THE INVENTION

This invention relates to a panel for holding interconnect and cross-connect equipment for telecommunications apparatus and, more particularly, to an improved panel of that type wherein connections are accessible at the front of the panel.

U.S. Pat. No. 5,552,962 discloses a jack panel module for the interconnection and cross-connection of telecommunications apparatus. The module has two pairs of connector sets on its rear adapted for electrically coupling the module to first and second telecommunications apparatus. On the front of the module are jacks adapted for electrically connecting, through patch cords, one of the telecommunications apparatus to a third telecommunications apparatus coupled to another module of the same type. In the past, these modules have been installed in brackets attached to frames wherein each bracket can accommodate twenty-four modules arrayed side-by-side. These modules require electrical power and therefore a power panel is also mounted to the frame. The power panel is capable of providing power for several groups of twenty-four modules.

The aforedescribed modules have been used in telephone central offices having aisles at the front and rear of the frames holding the modules, enabling access to cabling or patching on both sides of the modules. However, it is now proposed to utilize these modules in cabinets wherein there is access, after installation, only to the front of the modules. In addition, each of these cabinets can accommodate a maximum of twelve modules. It would therefore be desirable to provide a panel incorporating modules of the type described wherein there is cabling access at the front of the panel.

Since the new panel will only hold twelve modules, the prior art power panel would not be used to its full capacity. It would therefore be desirable to provide a lower capacity power module for a cabinet-mounted panel.

SUMMARY OF THE INVENTION

The present invention provides a panel for interconnect and cross-connect equipment for telecommunications apparatus. The panel has at least one connector module of a first type including sets of connectors at the rear and connectors at a front surface for receiving signal transmission conductors. Within each connector module of the first type, the front connectors are adapted to be utilized for monitoring signal transmission at the rear connectors without affecting connections between sets of the rear connectors through that connector module. The panel also has at least one connector module of a second type which includes a set of connectors each at the rear and at a front surface for receiving signal transmission conductors. Within each connector module of the second type each of the rear connectors is electrically connected to a respective one of the front connectors through that connector module. The panel further has a patch cord connectable between a set of connectors at the rear of a module of the first type and a set of connectors at the rear of a module of the second type. Accordingly, first telecommunications apparatus is connectable to the panel at the rear of a first type of connector module and second telecommunications apparatus is connectable to the panel at the front surface of a second type of connector module so that the first and second telecommunications apparatus are connected one to the other through the panel by means of a first type of connector module, a patch cord and a second type of connector module.

According to an aspect of this invention, the panel further includes a mounting bracket with a first plurality of adjacent slots for receiving a first plurality of the first type of connector module and an adaptor bracket mounted to the mounting bracket to cover an adjacent one-half of the first plurality of slots. The adaptor bracket has a second plurality of adjacent slots for receiving a second plurality of the second type of connector module, wherein the first plurality is an even number and the second plurality is equal to one half of the first plurality.

In accordance with a further aspect of this invention, the panel further includes a power module providing power to the connector modules of the first type and the adaptor bracket includes a slot for receiving the power module.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
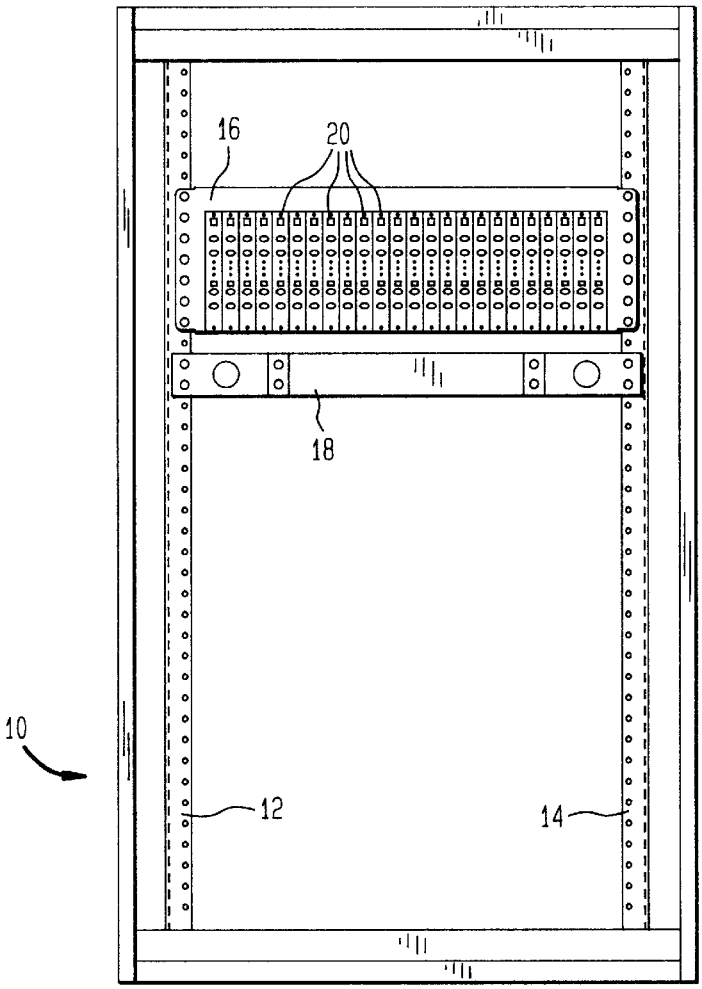
FIG. 1 (PRIOR ART)
FIG. 1 is a front view of a frame holding an interconnect and cross-connect equipment panel and a power panel, as is known in the prior art.

Referring now to the drawings, FIG. 1 illustrates a prior art frame, designated generally by the reference numeral 10, having a pair of uprights 12, 14 to which are mounted a bracket 16 and a power panel 18. The bracket 16 is provided with twenty four slots each for holding a respective jack panel module 20 of the type disclosed in the aforereferenced U.S. Pat. No. 5,552,962, the contents of which are hereby incorporated by reference. Only a single bracket 16 is shown in FIG. 1. However, the frame 10 is capable of accommodating numerous such brackets 16, wherein all of the jack panel modules 20 are powered by the power panel 18.

As previously described, all of the modules 20 have their input/output connections at the rear. In certain applications, such as when a cabinet is used instead of the frame 10, it is desirable to have the output connections of the modules 20 accessible at the front of the modules 20 without requiring the cabling to go over the top of the bracket 16.

Figure 2:
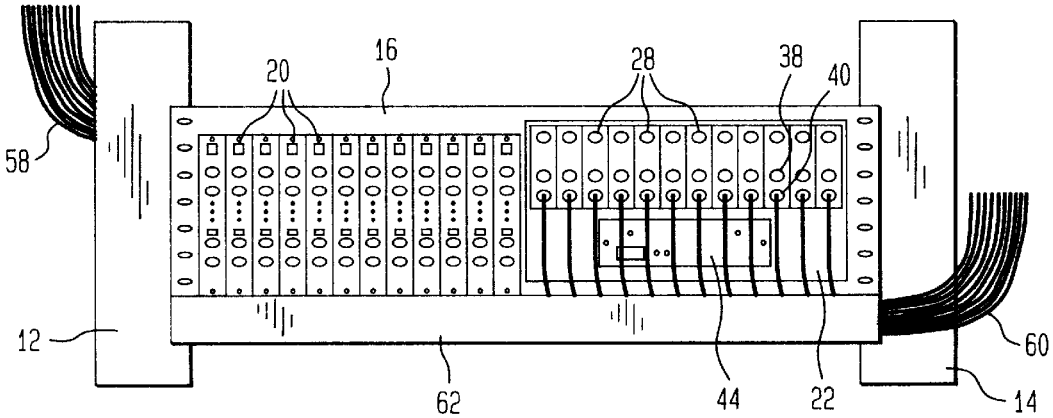
FIG. 2 is a front view of a first embodiment of an interconnect and cross-connect equipment panel according to the present invention.
Figure 3:
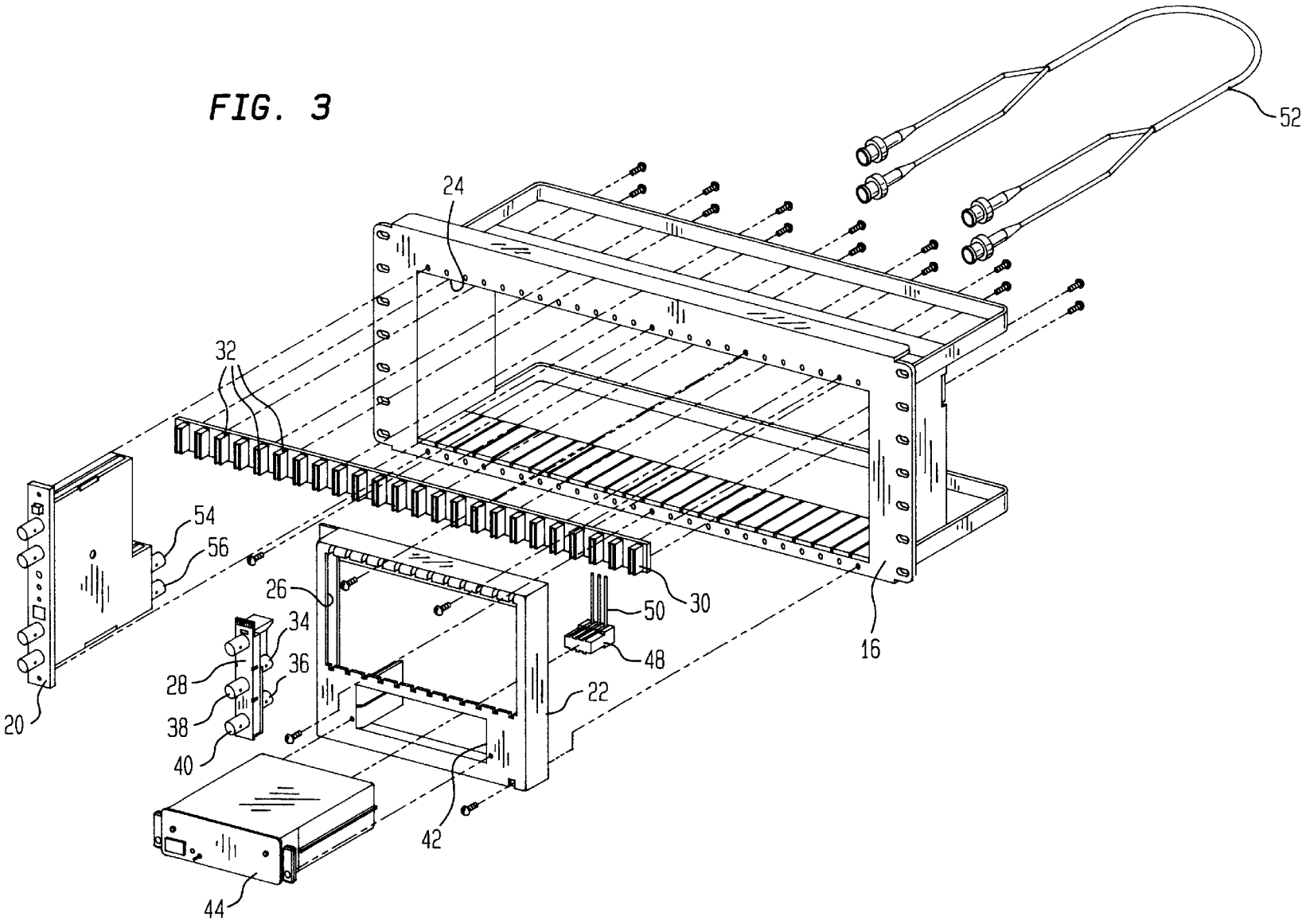
FIG. 3 is an exploded front perspective view of the panel shown in FIG. 2.

FIGS. 2 and 3 show an improved construction wherein the output connections are accessible at the front of the bracket 16. As shown, the bracket 16 is secured to the uprights 12, 14. An adaptor bracket 22 is secured to the bracket 16 so as to cover twelve of the twenty four slots available in the bracket 16. Specifically, the adaptor bracket 22 covers twelve adjacent slots, leaving twelve adjacent slots for the jack panel modules 20. Thus, the bracket 16 is formed with a rectangular opening 24 sufficient to hold twenty four of the modules 20 side-by-side with the major dimension of each module 20 being oriented vertically. The adaptor bracket 22 covers one-half of the opening 24 and has a rectangular opening 26 for holding twelve of the connector modules 28, which will be described in full detail hereinafter. The bracket 16 also has mounted thereon a power strip 30 having twenty four identical connectors 32 each aligned with a respective one of the slots of the bracket 16 so that when a jack panel module 20 is fully seated in a slot a connector at the rear of the module 20 mates with a respective aligned one of the connectors 32. The connectors 32 are connected in parallel and to a source of power for the modules 20, as will be described.

The connector modules 28 are passive in nature, having connectors 34, 36 at their rear which are directly connected to connectors 38, 40, respectively, on a front surface. The connector modules 28 are received side-by-side in twelve slots provided therefor in the rectangular opening 26 of the adaptor bracket 22.

The adaptor bracket 22 is further formed with a rectangular opening 42 having its major dimension horizontally aligned, with the opening 42 being vertically adjacent the opening 26. The opening 42 is sized to receive therein a power module 44. The power module 44 has a rear connector 46 (FIG. 5) which is mated with the connector 48. The connector 48 is attached to wires 50 which are in turn connected to the power strip 30, to provide power to the jack panel module 20.

A patch cord assembly 52 has connectors at one end to connect to the connectors 54, 56 at the rear of a jack panel module 20 and connectors at the other end to connect to the connectors 34, 36 at the rear of a connector module 28. Accordingly, the connectors 54, 56 at the rear of the jack panel module 20 are electrically connected to the connectors 38, 40 on the front surface of the connector module 28. As shown in FIG. 2, cabling 58 from first telecommunications apparatus is connected to the rear of the jack panel modules 20, and cabling 60 from second telecommunications apparatus is connected to connectors at the front of the connector modules 28. An optional cable trough 62 may be provided for routing the cabling 60.

Figure 4:
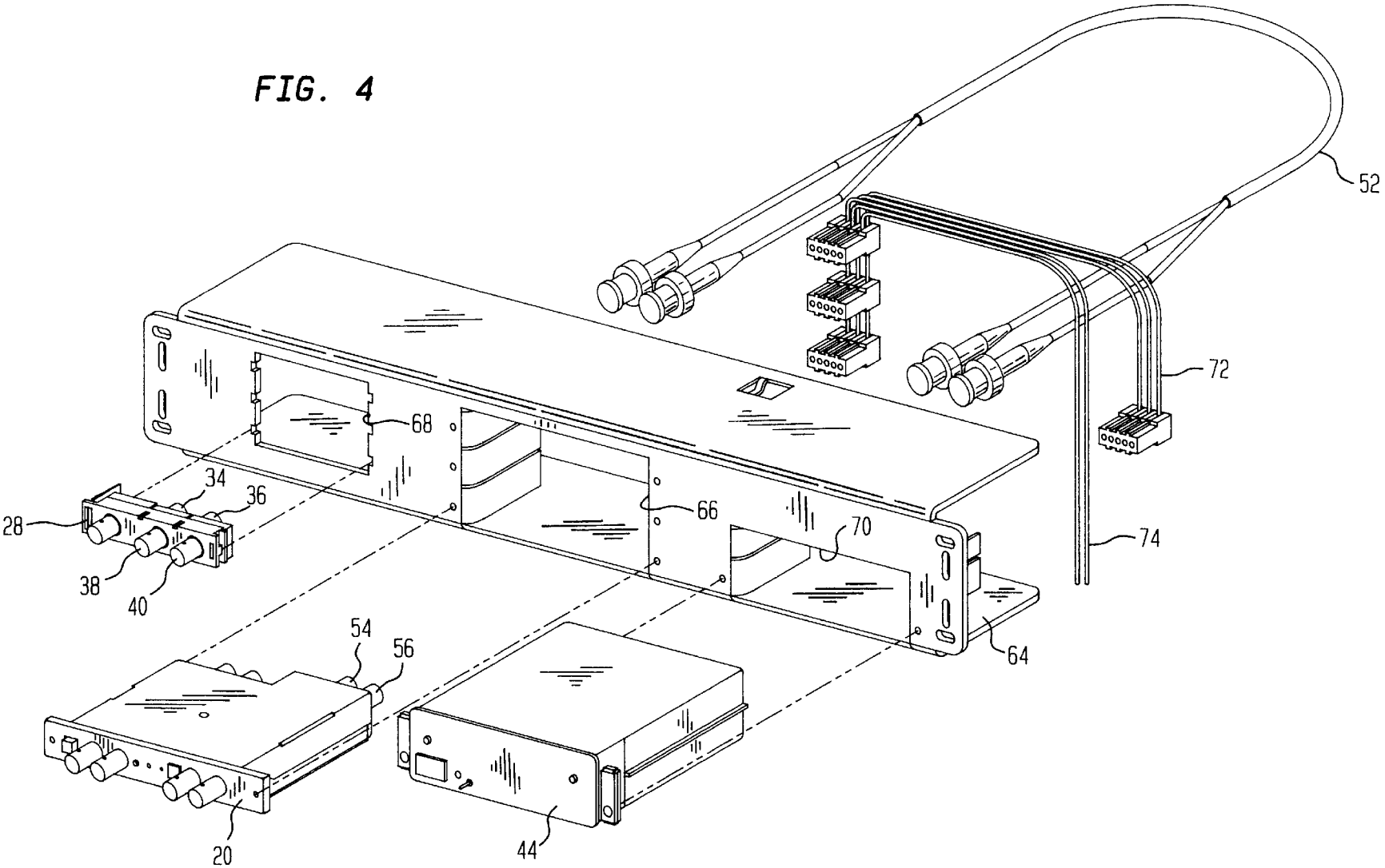
FIG. 4 is an exploded front perspective view of a second embodiment of an interconnect and cross-connect equipment panel according to the present invention.
Figure 5:
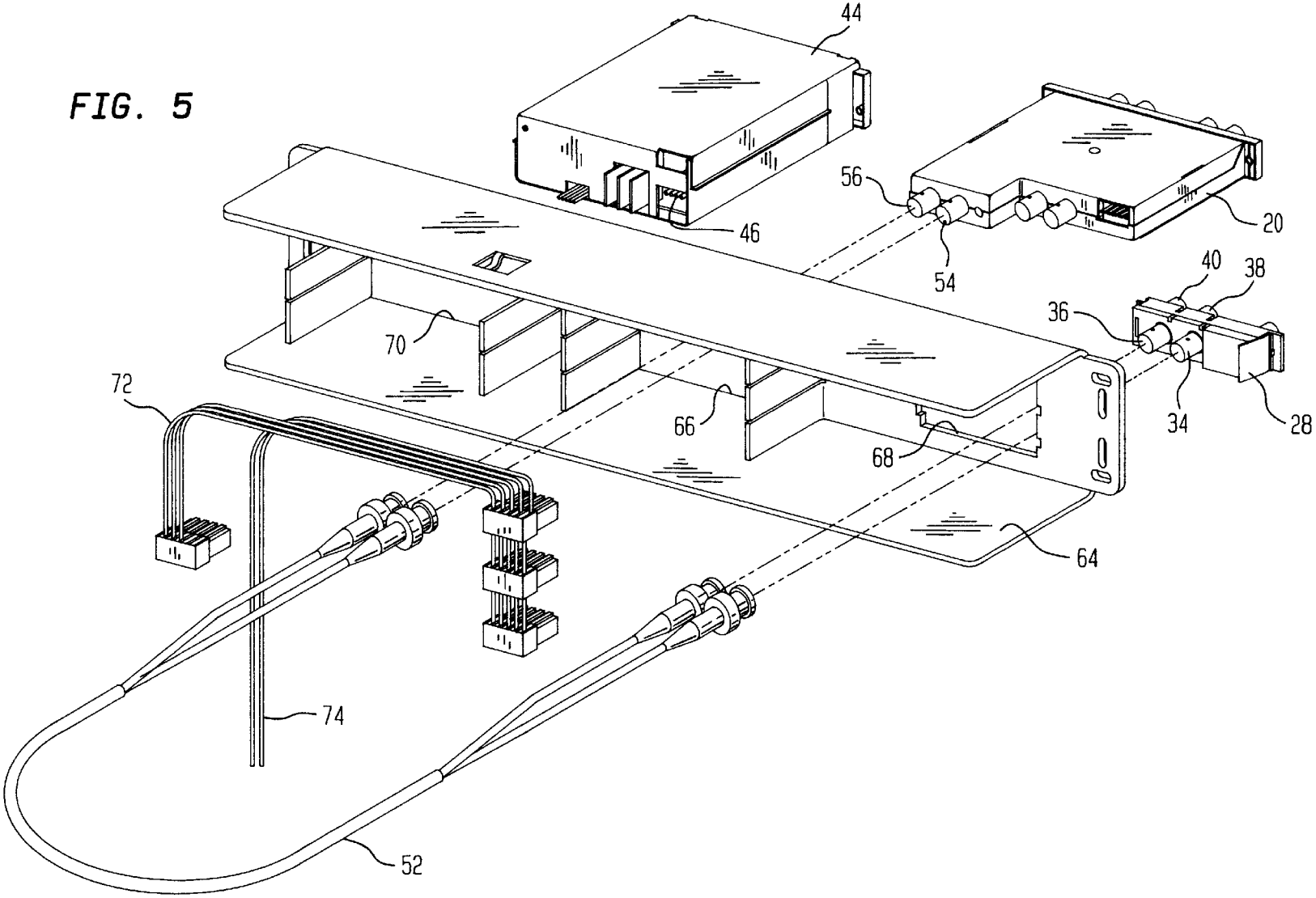
FIG. 5 is an exploded rear perspective view of the panel shown in FIG. 4.

There are applications wherein a very small number of jack panel modules 20 are required. FIGS. 4 and 5 illustrate a mounting bracket 64 which provides a low profile for up to three jack panel modules 20. As shown, the mounting bracket 64 has a rectangular opening 66 which provides three slots for receiving three jack panel modules 20 with their major dimension being horizontally aligned. A second rectangular opening 68 provides three slots for receiving three connector modules 28 with their major dimensions being horizontally aligned. Finally, the bracket 64 includes a third opening 70, which is rectangular in shape with its major dimension aligned horizontally, the opening 70 being in horizontal alignment with the openings 66 and 68. A connector harness 72 is provided to interconnect the power module 44 with the jack panel modules 20 so that the power module 44 can provide power to the modules 20. Additionally, the harness 72 includes wires 74 which can be used to provide power to another low profile bracket 64. As with the bracket shown in FIG. 3, a patch cord assembly 52 interconnects connectors 54, 56 at the rear of a jack panel module 20 with connectors 34, 36 at the rear of a connector module 28.

Figure 6:
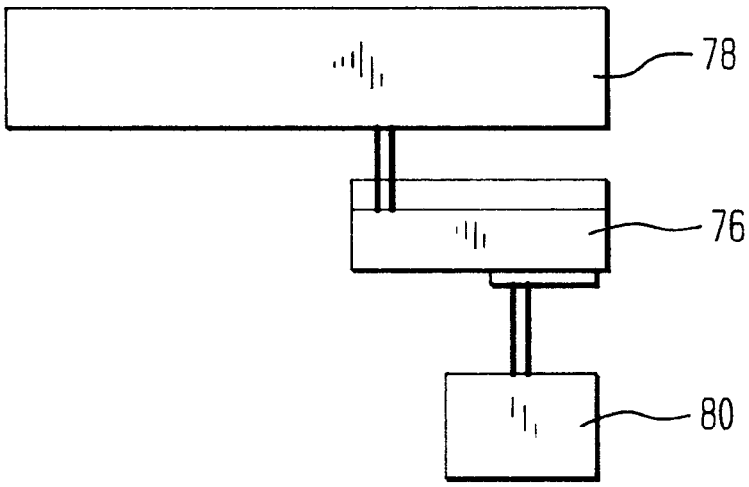
FIG. 6 is a schematic wiring diagram showing the inventive panel used in an interconnect application.

FIG. 6 illustrates an interconnect application for an improved panel 76 according to the present invention. Thus, as shown, network element 78 is connected to the rear connectors of the jack panel modules 20 of the panel 76 and network element 80 is connected to the front connectors of the connector modules 28 of the panel 76.

Figure 7:
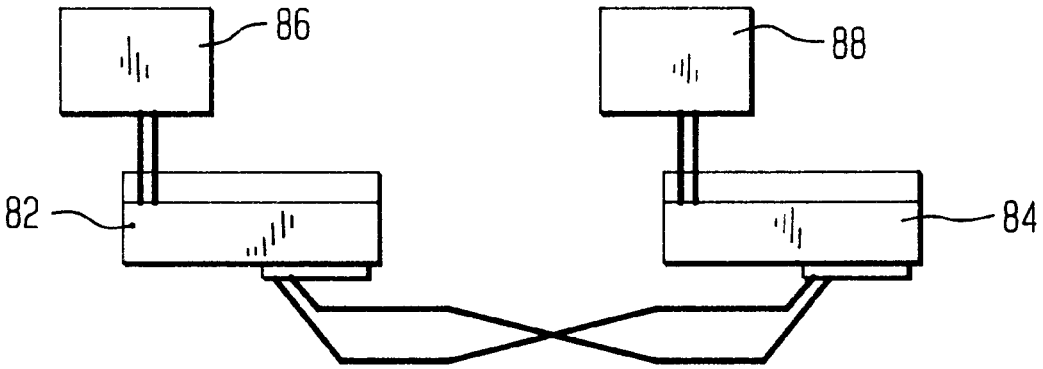
FIG. 7 is a schematic wiring diagram showing the inventive panel used in a cross-connect application.

FIG. 7 illustrates a cross-connect application using two panels 82 and 84 according to the present invention. As shown, the network element 86 is connected to the connectors at the rear of the jack panel modules 20 of the panel 82 and the network element 88 is connected to the connectors at the rear of the jack panel modules 20 of the panel 84. The two network elements 86, 88 are cross-connected at the front via the connector modules 28 on the front of each of the panels 82, 84.

Accordingly, there have been disclosed improved panels for holding interconnect and cross-connect equipment for telecommunications apparatus wherein connections are accessible at the front of the panels. While exemplary embodiments of the present invention have been disclosed herein, it will be appreciated by those skilled in the art that various modifications and adaptations to the disclosed embodiments may be made and it is intended that this invention be limited only by the scope of the appended claims.

What is claimed is:

1. A panel for interconnect and cross-connect equipment for telecommunications apparatus, comprising:

at least one connector module of a first type having sets of connectors at the rear and connectors at a front surface for receiving signal transmission conductors, wherein within each connector module of the first type the front connectors are adapted to be utilized for monitoring signal transmission at the rear connectors without affecting connections between sets of the rear connectors through said each connector module of the first type;

at least one connector module of a second type having a set of connectors each at the rear and at a front surface for receiving signal transmission conductors, wherein within each connector module of the second type each of the rear connectors is electrically connected to a respective one of the front connectors through said each connector module of the second type; and a patch cord connectable between a set of connectors at the rear of a module of the first type and a set of connectors at the rear of a module of the second type;

whereby first telecommunications apparatus is connectable to the panel at the rear of a connector module of the first type and second telecommunications apparatus is connectable to the panel at the front surface of a connector module of the second type, with the first and second telecommunications apparatus being connected one to the other through the panel by means of a connector module of the first type, a patch cord and a connector module of the second type.

2. The panel according to claim 1 further comprising:

a mounting bracket with a first plurality of adjacent slots for receiving a first plurality of said first type of connector module; and an adaptor bracket mounted to said mounting bracket to cover an adjacent one-half of said first plurality of slots, said adaptor bracket having a second plurality of adjacent slots for receiving a second plurality of said second type of connector module;

wherein said first plurality is an even number and said second plurality is equal to one-half of said first plurality.

3. The panel according to claim 2 further comprising:

a power module providing power to said connector modules of the first type; and wherein said adaptor bracket includes a slot for receiving said power module.

4. The panel according to claim 3 wherein said power module receiving slot is rectangular with its major dimension being horizontally aligned, and said power module receiving slot is vertically adjacent said second plurality of adjacent slots.

5. The panel according to claim 1 further comprising:

a power module providing power to said connector modules of the first type; and a mounting bracket having a first plurality of slots of a first type for receiving a first plurality of connector modules of the first type, a second plurality of slots of a second type for receiving a second plurality of connector modules of the second type, and a single slot of a third type for receiving the power module, wherein the first plurality equals the second plurality.

6. The panel according to claim 5 wherein:

each of the first type of slots is rectangular having a first major dimension and a first minor dimension, the slots of the first plurality of slots are adjacent to form a first rectangular opening of a size equal to the first major dimension by the first plurality times the first minor dimension, and the first rectangular opening is oriented in the mounting bracket so that its vertical dimension is less than its horizontal dimension;

each of the second type of slots is rectangular having a second major dimension and a second minor dimension, the slots of the second plurality of slots are adjacent to form a second rectangular opening of a size equal to the second major dimension by the second plurality times the second minor dimension, and the second rectangular opening is oriented in the mounting bracket so that its vertical dimension is less than its horizontal dimension; and said first and second rectangular openings are horizontally aligned.

7. The panel according to claim 6 wherein the third type of slot is rectangular having a third major dimension being horizontally aligned, and the third type of slot is positioned in horizontal alignment with said first and second rectangular openings.

* * * * *